United States Patent [19]

Sukolics

[11] 4,158,999

[45] Jun. 26, 1979

[54] SPECIAL PURPOSE WINDOW

[75] Inventor: Ronald D. Sukolics, Creve Coeur, Mo.

[73] Assignee: Swiss Aluminium Ltd., Chippis, Switzerland

[21] Appl. No.: 904,029

[22] Filed: May 8, 1978

[51] Int. Cl.[2] ..... E05G 7/00

[52] U.S. Cl. ..... 109/19; 186/1 C

[58] Field of Search ..... 109/1 V, 10, 19; 232/43.1, 44; 98/1, 88 R

[56] References Cited

U.S. PATENT DOCUMENTS 3,390,833 7/1968 Harris ..... 109/19 X 3,682,113 8/1972 McClellan ..... 109/19

*Primary Examiner*—Mervin Stein

*Assistant Examiner*—David H. Corbin

*Attorney, Agent, or Firm*—Bachman and LaPointe

[57] ABSTRACT

An improved special purpose window fur use in "drive-in" businesses such as restaurants, banks and the like is disclosed. The window reduces exterior art infiltration without interfering with the normal merchandise-money exchange between attendant and customer thereby significantly reducing the infiltration of carbon monoxide from the exterior of the building into the interior of the building.

17 Claims, 9 Drawing Figures

SPECIAL PURPOSE WINDOW

BACKGROUND OF THE INVENTION

The present invention is drawn in general to an improved window design and more specifically to an improved window design for use in "drive-in" businesses such as restaurants, banks and the like where an attendant is likely to be subjected to carbon monoxide and other noxious fumes which infiltrate the interior of a building from the exterior of same.

In our ever progressing society, it has become more and more common for various businesses to employ "drive-in windows" which enable customers to carry on transactions without ever having to leave their vehicles. Such drive-in arrangements have been found to be not only extremely convenient for the customers but also very efficient and time saving for the businesses.

While drive-in windows have become evermore popular in recent years, there is a very serious problem of exposing the attendants of these windows to toxic fumes, such as carbon monoxide, which eminate from the customer's vehicle as well as other sources. It has been found that attendants at these windows must be frequently relieved or else they experience nausea and headaches as a result of the toxic fumes.

Some relief from the toxic fumes has been accomplished through the use of a system which employs a slidable tray compartment under the window proper which is movable by the attendant from the interior of the building to the exterior where the customer can place his money in the tray and receive his goods therefrom. While the above-noted system eliminates some of the toxic fumes, it should be noted that toxic fumes are still capable of infiltrating the interior of the building via the slidable tray compartment since the system does not have any means for purging the air from the compartment. In addition to the above-noted disadvantage, the slidable tray system has been found to be a clumsy method of handling the normal merchandise-money exchange between customer and attendant.

Accordingly, it is the principal object of the present invention to provide an improved special purpose window for use in "drive-in" businesses which reduces exterior air infiltration.

It is a particular object of the present invention to provide an improved special purpose window which is characterized by means to purge toxic fumes from the window compartment.

It is still a further object of the present invention to provide an improved special purpose window which does not interfere with the normal merchandise-money exchange between attendant and customer.

Further objects and advantages of the present invention will appear hereinbelow.

SUMMARY OF THE INVENTION

In accordance with the present invention, the foregoing objects and advantages may be readily obtained.

The special purpose window of the present invention is characterized by an improved design which allows for the normal merchandise-money exchange between attendant and customer. The window of the present invention comprises means for purging the window chamber of toxic fumes thereby eliminating exterior air from infiltrating into the interior of the building.

The present invention resides in an improved special purpose window for use in "drive-in" businesses and the like. It is a particular feature of the present invention that the window of the present invention reduces exterior air infiltration to a minimum without interfering with the normal merchandise-money exchange between attendant and customer.

BRIEF DESCRIPTION OF THE DRAWINGS

The present invention will be more readily understood from a consideration of the following illustrative drawings in which.

DETAILED DESCRIPTION

Figure 1:
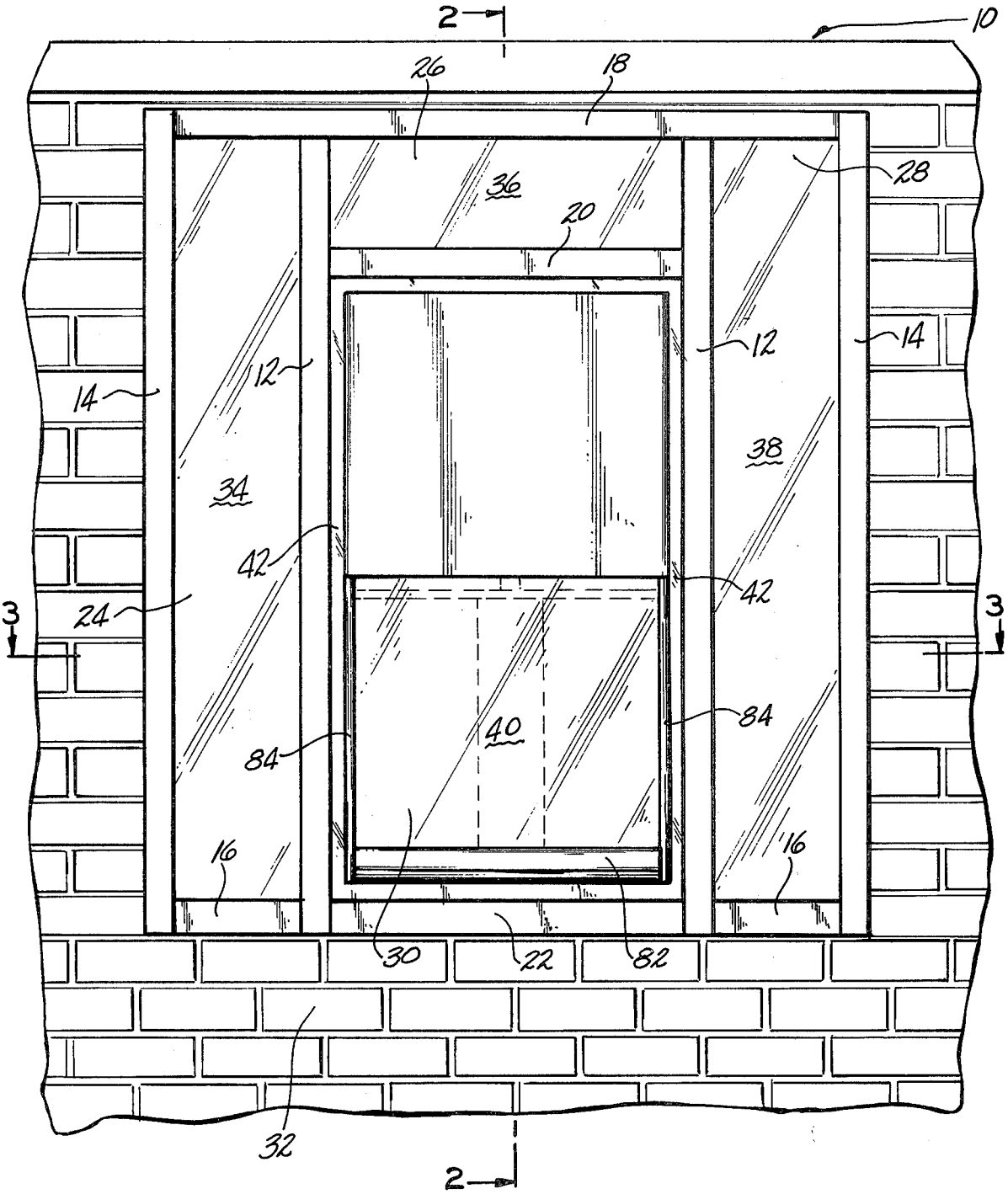
FIG. 1 is an exterior elevational outline of a window structure within the scope of the present invention.
Figure 2:
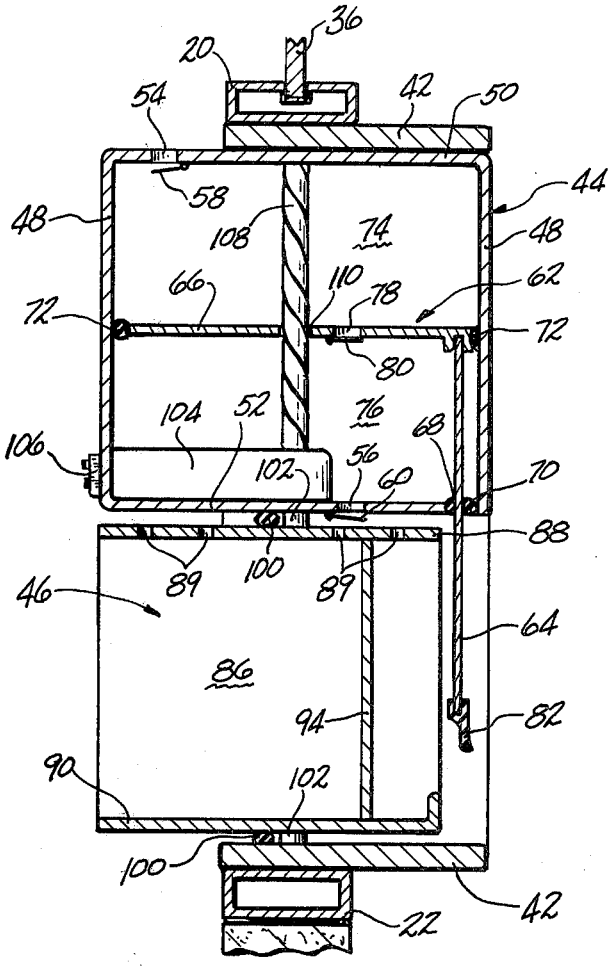
FIG. 2 is a vertical section taken substantially along line 2—2 of FIG. 1 illustrating the cooperating arrangement between the various components of the window structure of the present invention.
Figure 3:
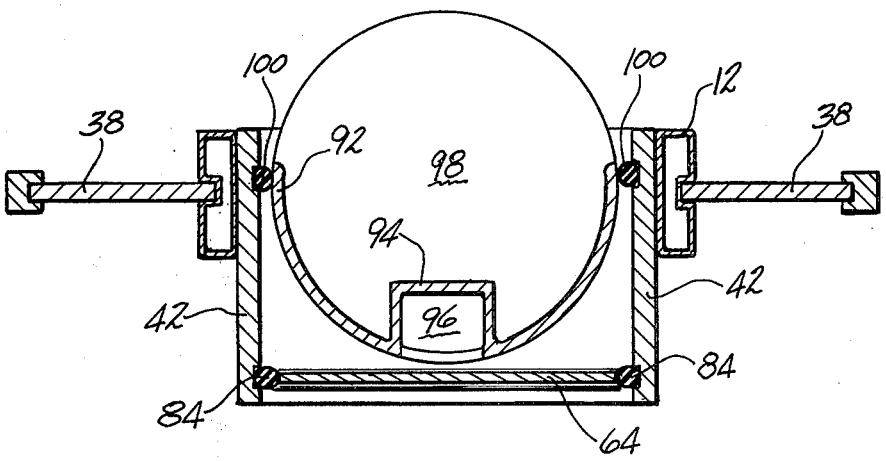
FIG. 3 is a horizontal section taken substantially along line 3—3 of FIG. 1 illustrating various components of the window structure of the present invention.

FIGS. 1 through 3 illustrate a preferred embodiment of the present invention. It is to be understood that this invention is not to be limited to that embodiment illustrated in the drawings.

Referring to the drawings, and in particular to FIGS. 1 through 3, the improved window structure of the present invention is generally designated by the reference numeral 10 and comprises a plurality of frame members 12, 14, 16, 18, 20 and 22 assembled together in any known manner so as to define a plurality of rectangular openings 24, 26, 28, and 30 in a wall 32 of a building or the like. While the frame members 12, 14, 16, 18, 20 and 22 can be formed in any suitable manner and of any suitable material, the frame members of the preferred embodiment illustrated are formed by extruding metal, such as aluminum-containing metal or the like, into desired stock lengths whereby the individual frame members can be subsequently cut into desired lengths to form the desired frame construction. The openings 24, 26 and 28, respectively, receive panel means 34, 36 and 38, each panel means preferably being formed of a rectangular sheet of transparent material such as plate glass, plastic, or the like. The opening 30 receives the improved window structure 40 of the present invention as described hereinafter.

The window structure 40 can be secured within opening 30 in any known conventional manner. In the preferred embodiment of the present invention, as illustrated herein in FIGS. 1 through 3, the window structure 40 is encased in a housing 42 to form a unitary assembly. The housing 42 containing window structure 40 is inserted into opening 30 and secured therein to frame members 12, 20 and 22 in any conventional manner such as screws, tongue and groove or the like. The joint between housing 42 and frame members 12, 20 and 22 can be sealed by conventional means such as caulking. While the window structure 40 is illustrated as being contained within a housing 42 within frame members 12, 20 and 22, it should be appreciated that housing 42 may be eliminated and window structure 40 may be housed by the frame members 12, 20 and 22 themselves.

Referring to the drawings, FIG. 2 is a vertical section of the window assembly of the present invention comprising an upper air chamber 44 and a lower window chamber 46. Upper air chamber 44 is formed by four side walls 48 and top and bottom walls 50 and 52, respectively. The top and bottom walls 50 and 52 are provided with a plurality of apertures 54 and 56, respectively. Each of the apertures 54 and 56 is adapted to receive one way valve means 58 and 60, respectively, which are provided with conventional means such as springs or the like to normally bias the respective valve means 58 and 60 so as to close the corresponding apertures 54 and 56 in top and bottom walls 50 and 52.

Mounted within upper air chamber 44 for vertical movement therein is window-baffle member 62 which consists of a transparent vertical slide 64 and a horizontal baffle member 66. Two of the side walls 48 of air chamber 44 are provided with vertical grooves, not shown, for guiding transparent vertical slide 64. Bottom wall 52 is provided with aperture 68 through which vertical slide 64 moves. Aperture 68 is provided with resilient seal means 70 through which vertical slide passes so as to effectively seal air chamber 44 from the lower window chamber 46. Horizontal baffle 66 is provided with a continuous seal means 72 along its entire edge to thereby sealingly divide air chamber 44 into a plurality of compartments, upper compartment 74 and lower compartment 76. Vertical slide member 64 is secured to horizontal baffle 66 by any conventional means, not shown, such as press fit, screws, glue or the like. Horizontal baffle 66 is provided with a plurality of apertures 78 for which one way valve means 80 are provided and biased in the same manner as previously described for one way valves 54 and 56. The lower portion of vertical slide 64 is adapted to receive along its entire length a soft flexible member 82 which, when the vertical slide is in its lowermost position, forms a seal with the bottom surface of housing 42 thereby effectively sealing window chamber 46 from the exterior of the building. As can be seen in FIG. 3, the edges of vertical slide 64 are provided with seals 84 which sealingly engage the side walls of housing 42.

Rotatably mounted for rotational movement within window chamber 46 is a carousel 86 comprising top and bottom circular discs 88 and 90, respectively, which are connected by a vertically extending transparent shield 92 which extends substantially 180° around the circumferential surface of respective top and bottom discs 88 and 90. Vertically extending transparent shield 92 effectively sealingly divides lower window chamber 46 into a first exterior window chamber and a second interior window chamber. Top circular disc 88 is provided with a plurality of apertures 89 along the entire surface thereof for reasons to be made clear hereinbelow when discussing the operation of the window. A portion of transparent shield 92 is provided with an indent 94 which effectively divides the carousel into two separate compartments 96 and 98, respectively. Seal means 100 is located on the peripheral surfaces of the carousel 86 and mates with the side and bottom walls of housing 42 as well as the bottom wall 52 of air chamber 44 so as to effectively seal the exterior of the building from the interior thereof. Both the top and bottom circular discs 88 and 90 are provided with trunnions 102 which are rotatably mounted in bearing means, not shown, in the corresponding bottom wall 52 of air chamber 44 and the bottom wall of housing 42.

Window-baffle member 62 and carousel 86 are adapted for vertical and rotational movement, respectively, as previously described hereinabove and may be actuated in any suitable manner and by any suitable means such as manual, hydraulic, pneumatic or electrical mechanisms. One suitable mechanism illustrated herein in FIG. 2 consists of an electric motor 104 located within the lower compartment 76 of air chamber 44. The motor is actuated by an attendant from a control panel 106 so as to rotate the carousel 86 180° in a clockwise and counterclockwise manner. Electric motor 104 is also adapted to drive in a clockwise and counterclockwise manner, a screw thread mechanism 108 which is vertically disposed in air chamber 44. Screw thread 108 is rotatably mounted in bearing means, not shown, in the top wall 50 of air chamber 44. Baffle member 66 of window-baffle member 62 is provided with an aperture 110 which receives screw thread mechanism 108 such that said screw thread member 108 carries baffle member 66 as electric motor 104 drives screw thread mechanism 108.

Figures 4A, 4B, 4C, 4D:
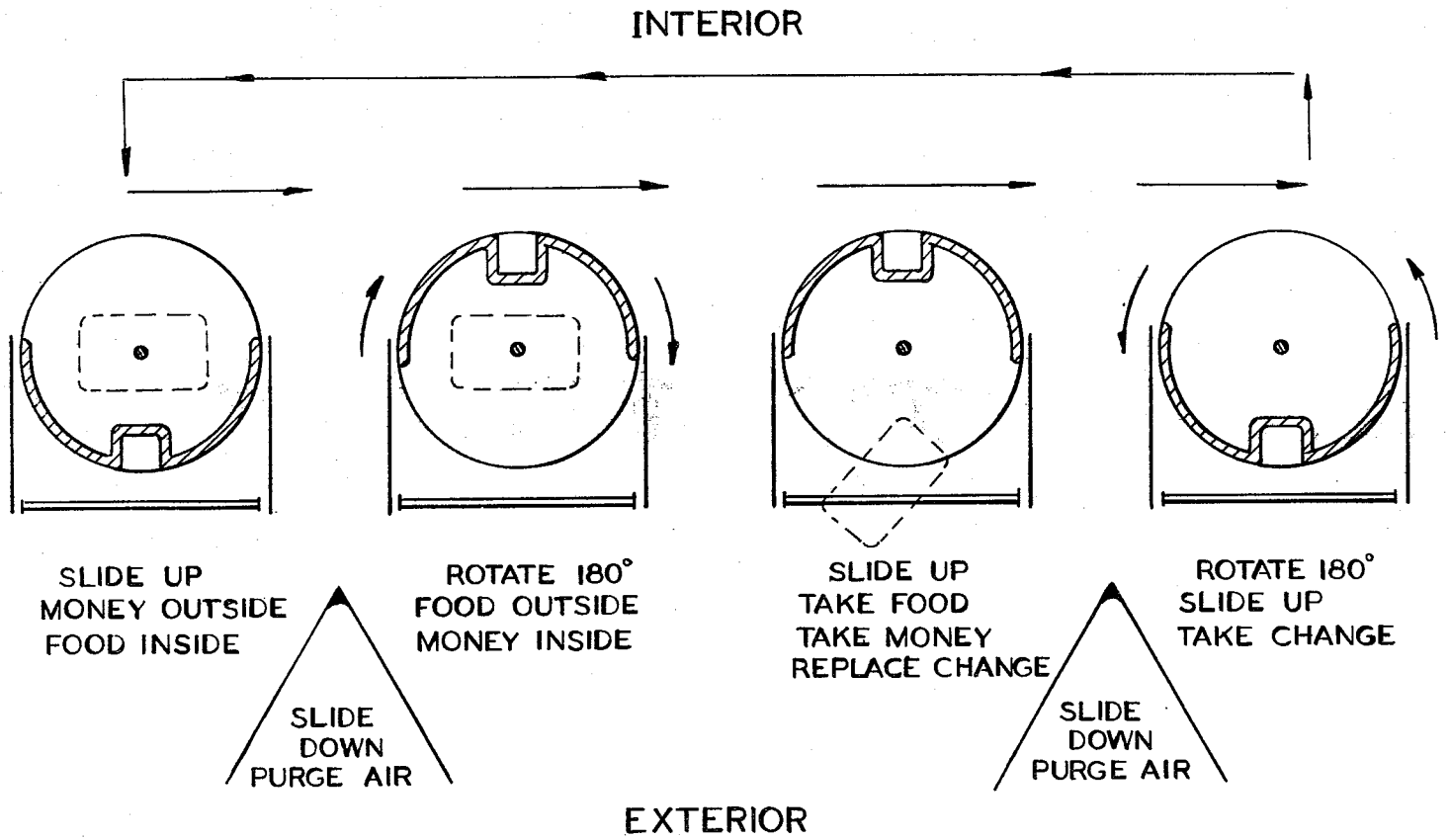
FIGS. 4A, 4B, 4C and 4D are fragmentary views illustrating the operational relationship between the carousel and vertical slide components of the window structure of the present invention.
Figure 5B:
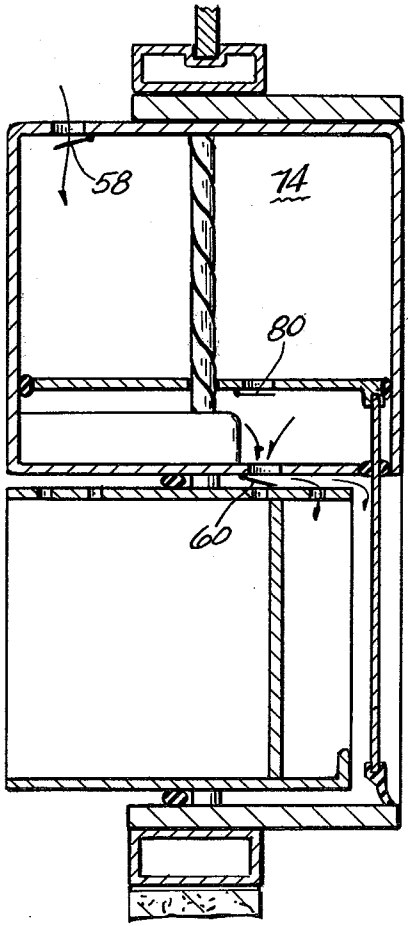
FIGS. 5A and 5B are fragmentary views illustrating the air purging operational relationship of the window structure of the present invention.
Figure 5A:
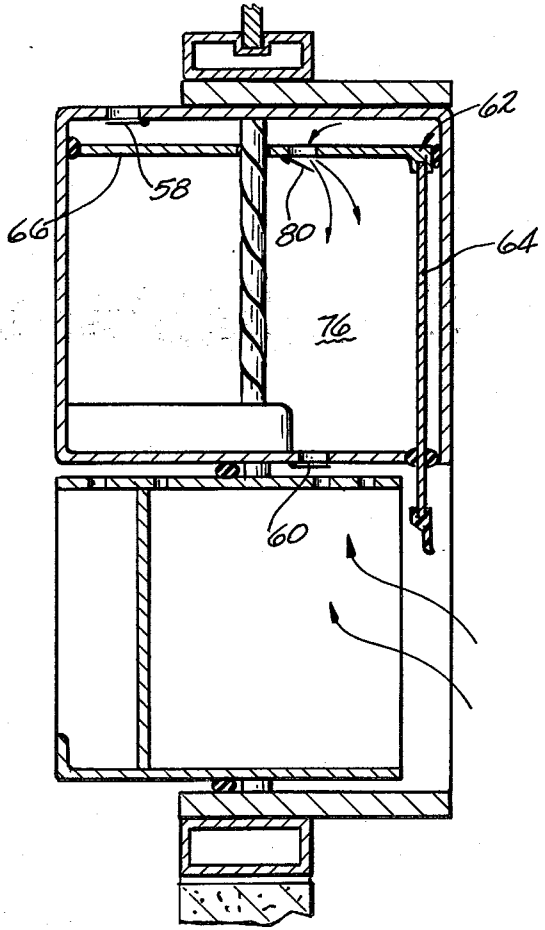

The operation of the window of the present invention will be better understood with reference to FIGS. 4 and 5 as illustrated herein. Referring now to the drawings, FIG. 4A is a fragmentary schematic illustration of the window of the present invention wherein transparent vertical slide 64 is in its lowermost position and carousel 86 is rotated such that shield 92 along with seal means 100 has effectively sealed compartment 96 from compartment 98 on the carousel 86. Assuming the attendant has placed the customer's order in compartment 98, the attendant actuates motor 104 as seen in FIG. 2, to raise transparent vertical slide 64 to its uppermost position thus allowing the customer to place the appropriate amount of money in compartment 96. With reference to FIG. 5A, it can be seen that when vertical slide 64 is raised, carbon monoxide or other toxic fumes infiltrate from the exterior of the building into compartment 96 in lower window chamber 94. As window-baffle member 62 is raised, one way valve means 80 on horizontal baffle member 66 is open due to the compression of air in upper compartment 74 thereby allowing the air in upper compartment 74 to enter lower compartment 76. After the customer has placed the money in compartment 96 the attendant actuates motor 104 so as to lower transparent vertical slide 64 to its lowermost position. As can be seen from FIG. 5B as window-baffle member 62 is lowered to its lowermost position vertical baffle member 66 compresses the air in lower compartment 76 forcing the same through apertures 56 past one way valve means 60 and through apertures 89 in circular disc 88 into compartment 96 in lower window chamber 46 thus purging compartment 96 and forcing substantially all the toxic fumes therein under vertical slide 64 to the exterior of the building as window-baffle member 62 is lowered. At the same time, the suction force in upper compartment 74 opens one way valve 58 and allows fresh air to pass from the interior of the building through apertures 54 into upper compartment 74.

Referring to FIG. 4B, once window-baffle member 64 is lowered to its lowermost position thereby sealing the exterior of the building from compartment 96 in lower window chamber 46, the attendant actuates carousel 86 so as to rotate same 180° thereby allowing the attendant to remove the customer's money from compartment 96. Referring to FIGS. 4C and 5A, the attendant then actuates motor 104 so as to again raise vertical slide 64 to its uppermost position as described hereinabove. Upon raising vertical slide 64 the customer removes his goods from compartment 98 thereby allowing compartment 98 to be contaminated from toxic fumes infiltrating from the exterior of the building. The attendant then actuates motor 104 to lower window-baffle member 62 to its lowermost position, as previously described above with reference to FIG. 5B, thereby allowing compartment 98 to be purged in the same manner as previously set forth. The attendant may then actuate motor 104 to rotate carousel 86 180° back to its original position, see FIG. 4D, where it is ready to receive the money from the next customer.

Accordingly, this invention provides a special purpose window which is capable of reducing exterior air infiltration without interfering with the normal merchandise-money exchange between attendant and customer thereby significantly reducing the infiltration of carbon monoxide and other toxic fumes into the interior of the building. The window is constructed so as to provide an effective means for purging toxic fumes from the window compartment while maintaining a simplicity of design.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An improved special purpose window for use in an exchange between an interior environment and an exterior environment comprising:

a window chamber;

delivery means adapted to sealingly mate with said window chamber so as to divide said window chamber into a first window chamber and a second window chamber, said delivery means including shield means associated therewith so as to divide said delivery means into a first delivery compartment within said first window chamber and a second delivery compartment within said second window chamber;

actuating means associated with said delivery means for moving said delivery means between a first position wherein said first delivery compartment is within said first window chamber and said second delivery compartment is within said second window chamber to a second position wherein said first delivery compartment is within said second window chamber and said second delivery compartment is within said first window chamber; and purging means associated with said first window chamber so as to purge said first window chamber prior to moving said delivery means between said first position and said second position.

2. A window according to claim 1 wherein said purging means includes an air chamber, said air chamber including a first one way valve means for communicating air from within said air chamber to said first window chamber.

3. A window according to claim 2 wherein said purging means includes a baffle means reciprocally mounted within said air chamber for forcing said air from said air chamber through said first valve means and into said first window chamber to purge said first window chamber, said baffle means being adapted to sealingly mate with said air chamber so as to divide said air chamber into a first air chamber compartment and a second air chamber compartment.

4. A window according to claim 3 wherein said baffle means includes window slide means secured thereto so as to reciprocate therewith, said window slide means being adapted to slide within said first air chamber compartment and said first window chamber between a first position wherein said first window chamber is sealed from said exterior environment to a second position wherein said first window chamber is exposed to said exterior environment.

5. A window according to claim 4 including means associated with said baffle means for reciprocating said baffle means such that said baffle means forces air from said first air chamber compartment to purge said first window chamber as said window slide means moves from said second position to said first position.

6. A window according to claim 5 wherein said window slide means is in said first position when said delivery means moves between said first position and said second position.

7. A window according to claim 1 wherein said delivery means comproses a carousel rotatably mounted within said window chamber.

8. A window according to claim 1 wherein said actuating member moves said delivery means from said second position back to said first position and said purging means purges said first chamber prior to moving said delivery means from said second position to said first position.

9. An apparatus for use in the exchange of goods between an interior environment and an exterior environment comprising:

a chamber;

means within said chamber and adapted to sealingly mate therewith so as to divide said chamber into a first chamber and a second chamber, said means having a first compartment within said first chamber and a second compartment within said second chamber;

actuating means for moving said means from a first position wherein said first compartment is within said first chamber and said second compartment is within said second chamber to a second position wherein said first compartment is within said second chamber and said second compartment is within said first chamber;

sealing means associated with said first window chamber and movable from a first position where said first chamber is sealed from said exterior environment to a second position where said first chamber is exposed to said exterior environment; and purging means associated with said first chamber so as to purge said first chamber as said sealing means moves from said second position to said first position prior to moving said means from said first position to said second position.

10. An apparatus according to claim 9 wherein said purging means comprises:

an air chamber;

baffle means sealingly mounted within said air chamber so as to divide said air chamber into a first air compartment and a second air compartment, said baffle means being adapted to reciprocate within said air chamber;

first one way valve means associated with said first air compartment for communicating air from said first air compartment to said first window chamber; and actuating means for reciprocating said baffle means within said air chamber such that said baffle means forces said air from said first air compartment into said first window chamber.

11. An apparatus according to claim 10 wherein said sealing means is secured to said baffle means so as to move with said baffle means.

12. An apparatus according to claim 11 wherein said means within said chamber is a carousel.

13. An apparatus according to claim 9 wherein said baffle means includes one way valve means associated therewith for communicating air from said second air compartment to said first air compartment.

14. An apparatus according to claim 13 wherein said second air compartment includes one way valve means associated therewith for communicating air from said interior environment to said second air compartment.

15. A method for preventing the infiltration of fumes from an exterior environment into an interior environment during the exchange of goods from said interior to said exterior, the method which comprises:

positioning delivery means having a first compartment and a second compartment within a chamber so as to divide said chamber into a first chamber and a second chamber;

providing actuating means for moving said delivery means from a first position wherein said first compartment is within said first chamber and said second compartment is within said second chamber to a second position wherein said first compartment is within said second chamber and said second compartment is within said first chamber; and purging said first chamber prior to actuating said delivery means to move from said first position to said second position.

16. A method according to claim 15 wherein said purging of said first chamber is by said interior environment.

17. A method according to claim 15, the method which comprises:

providing movable sealing means so as to seal said first chamber from said exterior environment when said sealing means is in a first position and exposing said first chamber to said exterior environment when said sealing means is in a second position; and moving said sealing means to said first position during said purging.

* * * * *